US005359970A

United States Patent [19]

Krebs

[11] Patent Number: 5,359,970

[45] Date of Patent: Nov. 1, 1994

[54] VALVE DRIVE FOR AN INTERNAL COMBUSTION ENGINE

[75] Inventor: Winfried Krebs, Ludwigsburg, Germany

[73] Assignee: Dr. Ing. h.c.F. Porsche AG, Germany

[21] Appl. No.: 143,896

[22] Filed: Nov. 1, 1993

[30] Foreign Application Priority Data

Oct. 30, 1992 [DE] Germany ..... 4236655

[51] Int. Cl.[5] ..... F01L 1/34; F01L 1/04; F02D 13/02

[52] U.S. Cl. ..... 123/90.17; 123/90.18; 123/90.6; 74/567; 74/568 R

[58] Field of Search ..... 123/90.15, 90.16, 90.17, 123/90.18, 90.31, 90.6; 74/567, 568 R

[56] References Cited

U.S. PATENT DOCUMENTS

| | | | |
|---|---|---|---|
| 3,986,484 | 10/1976 | Dyer | 123/90.18 |
| 4,399,784 | 8/1983 | Foley | 123/90.18 |
| 4,730,588 | 3/1988 | Maeda | 123/90.18 |
| 4,794,893 | 1/1989 | Masuda et al. | 123/90.17 |
| 4,870,872 | 10/1989 | Parsons | 123/90.17 |
| 4,886,022 | 12/1989 | Nakai | 123/90.17 |
| 5,129,407 | 7/1992 | Phillips | 123/90.18 |
| 5,158,049 | 10/1992 | Neumann | 123/90.17 |

FOREIGN PATENT DOCUMENTS

| | | |
|---|---|---|
| 2037705 | 2/1971 | Germany . |
| 2950656 | 6/1981 | Germany . |
| 3042018 | 5/1982 | Germany . |
| 3713646 | 11/1987 | Germany . |
| 3732687 | 4/1988 | Germany . |
| 3920938 | 1/1990 | Germany . |
| 4201473 | 8/1992 | Germany . |
| 4230877 | 4/1993 | Germany . |
| 4236892 | 5/1993 | Germany . |
| 3003907 | 3/1991 | Japan . |

*Primary Examiner*—E. Rollins Cross
*Assistant Examiner*—Weilun Lo
*Attorney, Agent, or Firm*—Evenson, McKeown, Edwards & Lenahan

[57] ABSTRACT

The valve drive of an internal combustion engine has sliding cams which are pretensioned and displaceable axially on a camshaft. The sliding cams are displaceable from a first position in which they act by a first elevation curve on intake valves into a second position in which they act by a second elevation curve on the intake valves. The sliding cams in the first position positively abut a stop of a transfer element connected between the intake valves and the sliding cams, so long as they travel with a segment in the vicinity of the stop. When the base circle of the sliding cams is reached, the sliding cams are displaced into the second position.

20 Claims, 2 Drawing Sheets

FIG. 1
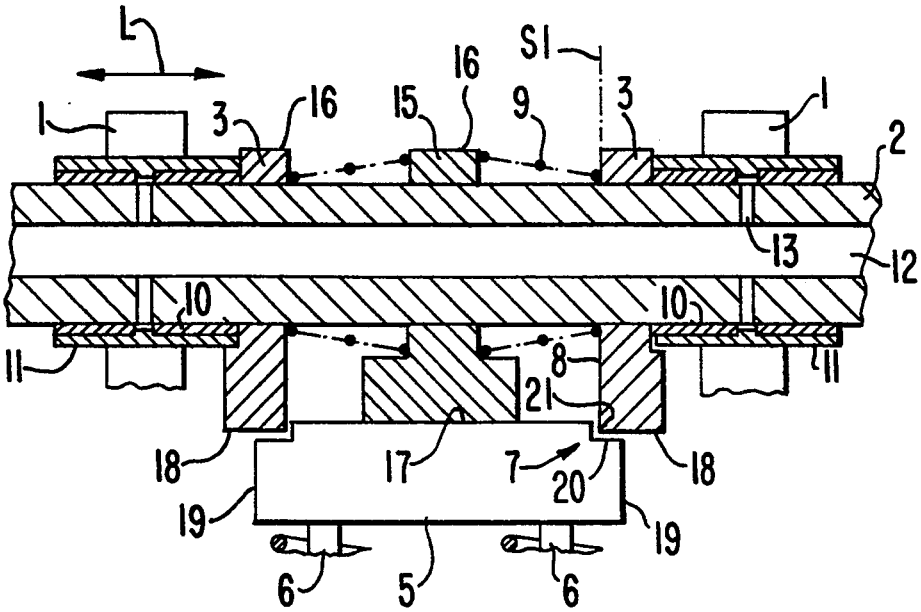
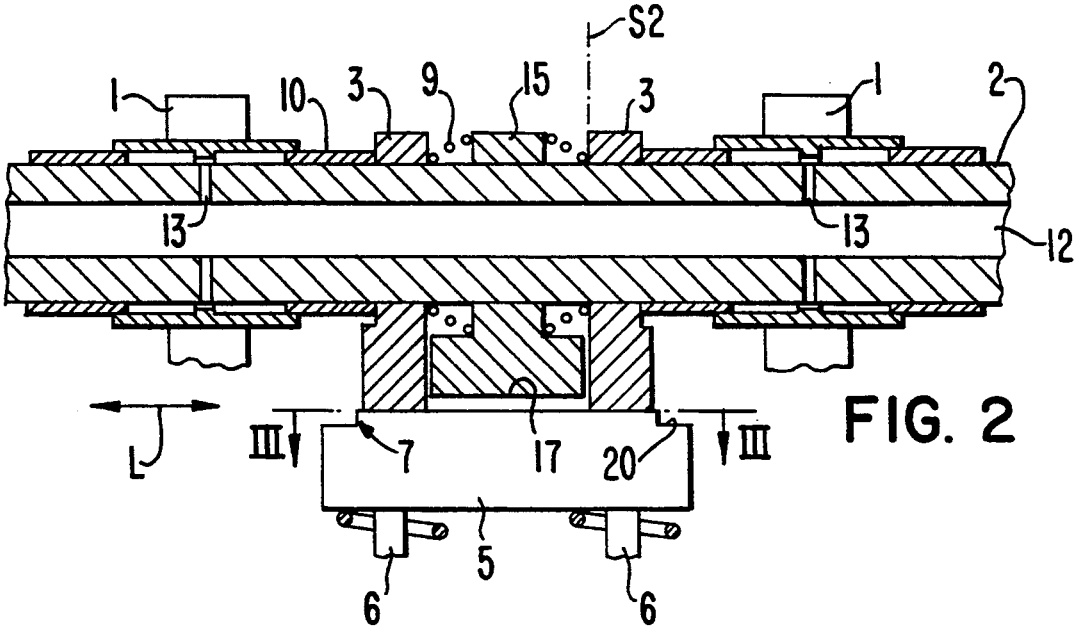
FIG. 2
FIG. 3
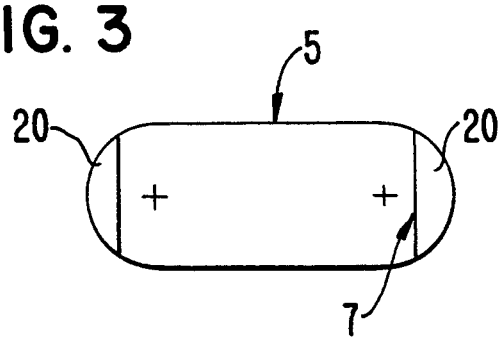

VALVE DRIVE FOR AN INTERNAL COMBUSTION ENGINE

BACKGROUND AND SUMMARY OF THE INVENTION

The invention relates to a valve drive for an internal combustion engine and, more particularly, to a valve drive for an internal combustion engine having a camshaft mounted in bearings and with at least one axially displaceable cam. The cam, with interposition of a transfer element, actuates at least one gas-exchange valve.

German Patent Document DE OS 20 37 705 describes a known valve drive with a hydraulically axially displaceable camshaft, on which fixed cams with two different elevation curves are mounted. When the oil pressure is switched on, gas-exchange valves with a larger valve lift are actuated in one end position of the camshaft, while when the oil pressure is shut off the camshaft, displaced into a second end position under spring tension, actuates the valves with a lesser valve lift.

A disadvantage of the known valve drive in this regard is the simultaneous axial displacement of all of the cams. As a result of the angular offset of the cams with respect to one another, in a multicylinder internal combustion engine, there cannot be any position of the camshaft in which all of the cams simultaneously travel on their base circles as would be required for axial displacement. In addition, in internal combustion engines with only one camshaft per row of cylinders, the cams associated with the exhaust valves are displaced as well.

A valve drive is known from German Patent Document DE-29 50 656 A1 having cams that are displaceable, as well as axially and helically rotatable, on the camshaft. The cams are held positively on the camshaft by spiral threads. Axially displaceable shafts run parallel to the camshaft. The shafts engage the cams externally in sliding fashion by dogs. The shafts rotate the cams relative to the camshaft to adjust optimum control times. The cams actuate gas-exchange valves with interposition of transfer elements designed as valve lifters. This arrangement requires considerable space because of the axially displaceable shafts. Further, the arrangement is heavy and is prone to wear due to the sliding contact between the rotating cams and dogs. In addition, a spiral toothing on the camshaft is costly to manufacture.

There is therefore needed a valve drive that overcomes these disadvantages.

These needs are met according to the present invention which provides a valve drive for an internal combustion engine having a camshaft mounted in bearings and with at least one axially displaceable cam. The cam, with interposition of a transfer element, actuates at least one gas-exchange valve. The cam is designed as a non-rotatable sliding cam that is displaceable relative to a camshaft and axially pretensioned in a first position positively abutting a stop provided between the sliding cam and the transfer element. The valve drive of the present invention has the advantage that the gas-exchange valves of all cylinders in one row of cylinders can be actuated with this valve drive. The sliding cams then rest, axially pretensioned, against the stops for as long as they rest against this stop by the portions of their ends that are delimited by the elevation curves. When the base circle of each sliding cam reaches the transfer element, the sliding cams are displaced and ride with their elevation curves on the transfer element.

This valve drive can be used, for example, for directly actuated valves, with the transfer element designed as a cup tappet provided with hydraulic valve play adjustment. In addition, the valve drive can be used in valve drives provided with levers. The transfer element is then designed as a rocker arm, valve lifter, or the like.

The sliding cams can be provided with two elevation curves, with the section abutting the stop being provided between the two elevation curves.

The various elevation curves travelling on the transfer element can have an angular offset with respect to one another, so that a phase shift results. This phase shift can be used jointly with the variation of the valve travel or instead of the latter.

Other objects, advantages and novel features of the present invention will become apparent from the following detailed description of the invention when considered in conjunction with the accompanying drawings.

BRIEF DESCRIPTION OF THE DRAWINGS

FIG. 1 is a lengthwise cross-sectional view through a first embodiment of the invention with the sliding cams in a first position.

FIG. 2 is a cross-sectional view similar to FIG. 1 with the sliding cams in a second position;

FIG. 3 is a cross-sectional view taken along line III—III of FIG. 2;

DETAILED DESCRIPTION OF THE DRAWINGS

Figure 4:
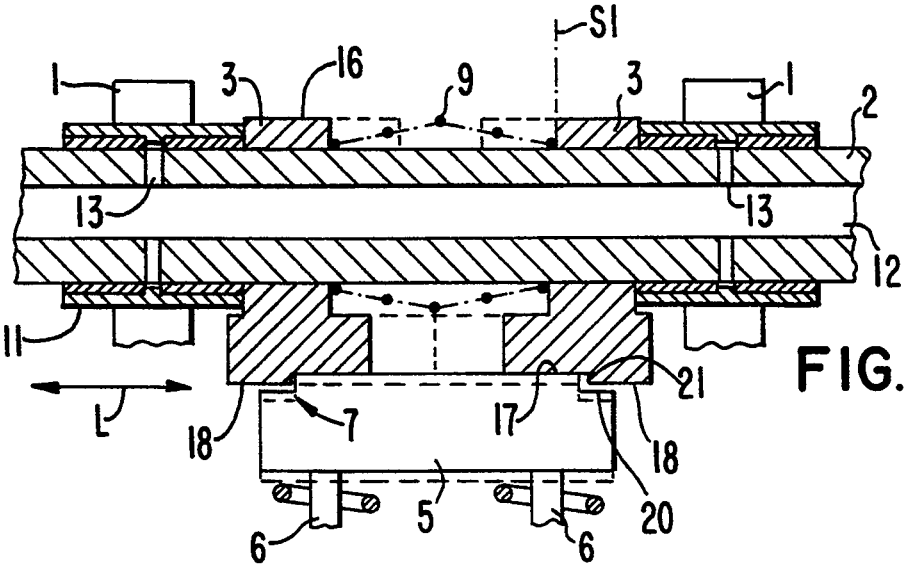
FIG. 4 is a lengthwise cross-sectional view through a second embodiment.

A valve drive of an internal combustion engine (not shown) has a camshaft 2 mounted in bearings 1 and driven in the usual fashion by a crankshaft.

On camshaft 2, a non-rotating cam is provided, displaceable relative to the camshaft in a lengthwise direction L and designed as a sliding cam 3. This sliding cam 3 is displaceable along a guide 4 (FIG. 6) linking it and camshaft 2 positively from a first position S1 to a second position S2.

Sliding cam 3, with interposition of a transfer element 5, actuates two gas-exchange valves designed as intake valves 6.

A stop 7 is provided between sliding cam 3 and transfer element 5. Sliding cam 3, axially pretensioned, abuts this stop 7 with one of its ends 8. The axial pretensioning is provided by either a compression spring 9 or a hydraulically actuated piston 10.

This piston 10 is mounted displaceably in a sleeve 11, in turn located between bearing 1 and camshaft 2. Piston 10 is connected to a hydraulic circuit (not shown) through a central channel 12 of camshaft 2 and radial bores 13 branching therefrom. The circuit charges the central channel 12 with compressed oil depending on the parameters of the internal combustion engine, or keeps it free of compressed oil.

In a first embodiment of the invention according to FIG. 1, a fixed cam 15 is mounted centrally on camshaft 3 between two sliding cams 3 displaceable opposite one another. Compression springs 9 abut the sliding cams 3 on each side. The springs 9 hold the sliding cams 3 in the first position S1 when the oil pressure is shut off.

All cams 3, 15 have a base circle 16. Fixed cam 15 has a first elevation curve 17 which has a smaller stroke than second elevation curve 18 of sliding cam 3.

Transfer element 5 has stops 7 designed as stepped recesses 20 on the ends 19 facing the sliding cams 3.

Initially, during operation of internal combustion engines with central channel 12 free of pressurized oil, valves 6 are actuated by fixed cam 15 according to its elevation curve 17. Sliding cams 3 rotate jointly with fixed cam 15 without traveling onto transfer element 5, since recess 20 provides sufficient free play for the second elevation curves 18.

When the pressurized oil is switched on, pistons 10 press on the other ends 8 of the sliding cams 3, facing away from the compression springs 9, and attempt to displace cams 3 in the direction of fixed cam 15. If sliding cams 3, when the compressed oil is connected, travel so that a portion 21 of one of their ends 8, delimited by their elevation curves 18, enters recess 20, sliding cams 3 will positively abut stop 7 positively by virtue of hydraulic pretensioning. If during further rotation of sliding cams 3, segment 21 leaves the vicinity of recess 20, they are displaced, traveling on base circle 16, into the second position S2 shown in FIG. 2. Intake valves 6 are then actuated according to the second elevation curve 18.

Advantageously, during a single revolution of camshaft 2, all sliding cams 3 for a row of cylinders of the internal combustion engine can be actuated. Sliding cams 3 traveling on their base circles 16 when compressed oil is switched on are immediately displaced into second position S2, while all the others briefly abut stop 7 before they are displaced into this position S2. Separate hydraulic control for each individual cylinder of the internal combustion engine can be eliminated.

According to a second embodiment of the invention shown in FIG. 4, two sliding cams 3, displaceable opposite one another, have a first and a second elevation curve 17 and 18 respectively. When the oil pressure is switched off, both sliding cams 3 are under spring tension in first position S1 and have first elevation curves 17 acting on transfer element 5. Recess 20 in turn provides sufficient freedom of movement for elevation curves 18, provided with greater travel.

When the pressurized oil is switched on, sliding cams 3 initially again have segment 21 abutting stop 7 before they are displaced along their basic circles 16 into the second position S2 represented by the dashed lines in FIG. 4, in which they act on valves 6 with their second elevation curves 18.

Figure 5:
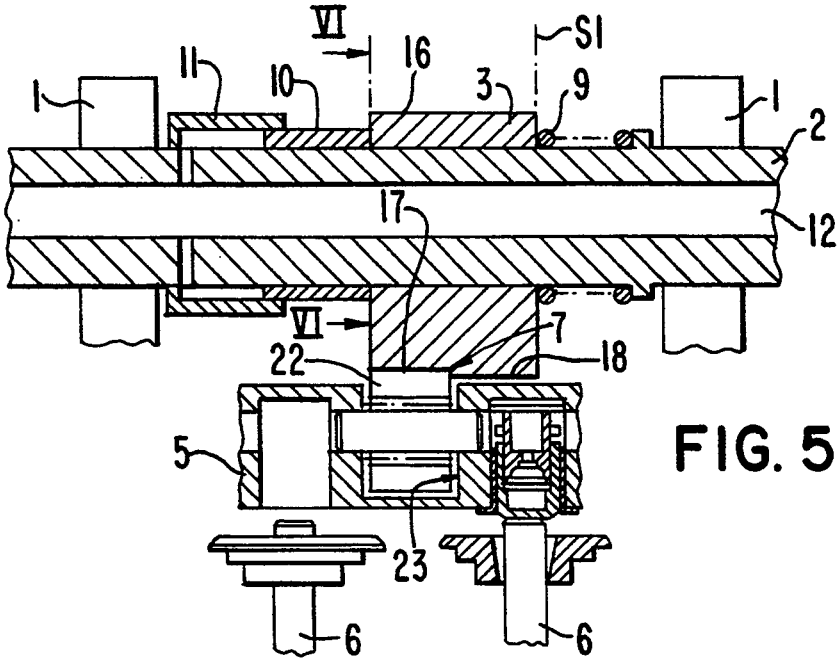
FIG. 5 is a lengthwise cross-sectional view through a third embodiment.

The third embodiment according to FIG. 5 has a single sliding cam 3 with two elevation curves 17 and 18. Sleeve 11 is mounted separately on camshaft 2, adjacent to a bearing 1.

Transfer element 5 has a roller 22 which uniformly distributes the transferred forces. One end 23 of the roller forms a stop 7 for segment 21. In the first position S1, roller 22 is in contact with elevation curve 17 and in the second position S2, it is in contact with elevation curve 18.

Figure 6:
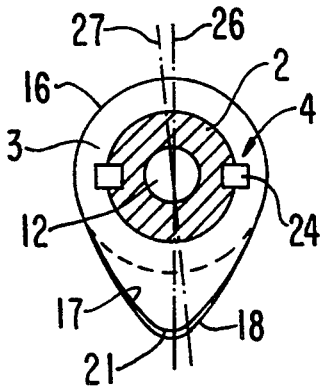
FIG. 6 is a cross-sectional view taken along line VI—VI of FIG. 5.

FIG. 6 shows the positive connection provided in all of the embodiments between sliding cams 3 and camshaft 2 by guide 4 running in a lengthwise direction L, which is formed, for example, by feather keys 24 inserted in grooves.

In addition to the variations in the valve stroke made possible by the valve drive according to the invention, a phase shift can be achieved between the first and second elevation curves, in which these curves are disposed angularly offset with respect to one another. This angular offset can also be accomplished without varying the stroke, so that the valve drive acts as a phase changer. In FIG. 6, line 26 shows the congruent main axes of elevation curves 17 and 18 which are in phase, while dashed line 27 shows the main axis of a phase-shifted elevation curve.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A valve drive for an internal combustion engine which actuates at least one gas-exchange valve, comprising:
   - a camshaft mounted in bearings;
   - at least one axially displaceable cam provided on said camshaft;
   - a transfer element interposed between said at least one axially displaceable cam and said at least one gas exchange valve;
   - wherein said at least one axially displaceable cam is a sliding cam, said sliding cam being axially displaceable and non-rotatable relative to said camshaft and being axially pretensioned in a first position on said camshaft;
   - wherein said sliding cam positively abuts a stop provided between said sliding cam and said transfer element in the first position.

2. A valve drive according to claim 1, wherein said sliding cam abuts said stop with a segment of one of its ends delimited by its elevation curve.

3. A valve drive according to claim 2, wherein said stop is formed by a stepped recess provided on said transfer element.

4. A valve drive according to claim 3, wherein two stops are provided on said transfer element, opposite one another in the lengthwise direction of said camshaft, and acting opposite to one another.

5. A valve drive according to claim 2, wherein said stop is formed by an end of said transfer element facing said segment of said sliding cam.

6. A valve drive according to claim 3, wherein said segment separates two elevation curves provided on said sliding cam.

7. A valve drive according to claim 5, wherein said segment separates two elevation curves provided on said sliding cam.

8. A valve drive according to claim 6, wherein said sliding cam travels with first elevation curves in said first position and with second elevation curves in a second position on said transfer element.

9. A valve drive according to claim 7, wherein said sliding cam travels with first elevation curves in said first position and with second elevation curves in a second position on said transfer element.

10. A valve drive according to claim 3 wherein sliding cams are provided on both sides adjacent to a fixed cam on said camshaft, said sliding cams being provided with single elevation curves that act on said transfer element in said first position.

11. A valve drive according to claim 1, wherein said sliding cam is displaced by a hydraulically actuated piston from one of said first position and a second position, into the other position.

12. A valve drive according to claim 2, wherein said sliding cam is displaced by a hydraulically actuated piston from one of said first position and a second position, into the other position.

13. A valve drive according to claim 3, wherein said sliding cam is displaced by a hydraulically actuated piston from one of said first position and a second position, into the other position.

14. A valve drive according to claim 4, wherein said sliding cam is displaced by a hydraulically actuated piston from one of said first position and a second position, into the other position.

15. A valve drive according to claim 5, wherein said sliding cam is displaced by a hydraulically actuated piston from one of said first position and a second position, into the other position.

16. A valve drive according to claim 1, wherein a positive and non-rotational guide running in said lengthwise direction is provided between said camshaft and said sliding cam.

17. A valve drive according to claim 2, wherein a positive and non-rotational guide running in said lengthwise direction is provided between said camshaft and said sliding cam.

18. A valve drive according to claim 3, wherein a positive and non-rotational guide running in said lengthwise direction is provided between said camshaft and said sliding cam.

19. A valve drive according to claim 4, wherein a positive and non-rotational guide running in said lengthwise direction is provided between said camshaft and said sliding cam.

20. A valve drive according to claim 5, wherein a positive and non-rotational guide running in said lengthwise direction is provided between said camshaft and said sliding cam.

* * * * *